United States Patent [19]

Teder et al.

[11] Patent Number: 4,786,365

[45] Date of Patent: Nov. 22, 1988

[54] PROCESS OF MAKING CELLULOSE PULP WITH A SULPHITE COOKING LIQUOR CONTAINING SULPHIDE AND A QUINONE OR HYDROQUINONE COMPOUND

[75] Inventors: Ants Teder, Täby; Leelo Olm, Saltsjöbaden; Jan-Erik Wilkén, Täby, all of Sweden

[73] Assignee: Svenska Traforskningsinstitutet, Stockholm, Sweden

[21] Appl. No.: 158,099

[22] Filed: Feb. 16, 1988

Related U.S. Application Data

[63] Continuation of Ser. No. 876,867, filed as PCT SE85/00321 on Aug. 29, 1985, published as WO86/02393 on Apr. 24, 1986.

[30] Foreign Application Priority Data

Oct. 10, 1984 [SE] Sweden ..... 8405061

[51] Int. Cl.[4] ..... D21C 3/06; D21C 3/20; D21C 3/26

[52] U.S. Cl. ..... 162/65; 162/72; 162/83; 162/84

[58] Field of Search ..... 162/83, 72, 82, 65, 162/19, 84

[56] References Cited

U.S. PATENT DOCUMENTS

| | | | |
|---|---|---|---|
| 1,387,441 | 8/1921 | Braun | 162/83 |
| 3,262,839 | 7/1966 | Lüthgens | 162/83 |
| 4,012,280 | 3/1977 | Hulton | 162/72 |
| 4,213,821 | 7/1980 | Vanderhock et al. | 162/83 |
| 4,363,700 | 12/1982 | Wada et al. | 162/83 |

*Primary Examiner*—Steve Alvo

*Attorney, Agent, or Firm*—Burns, Doane, Swecker & Mathis

[57] ABSTRACT

A process of manufacturing cellulose pulp from wood by digesting the wood with sulphite cooking liquor containing additions of sulphide and in the presence of a quinone or hydroquinone compound. According to the invention, the mole ratio between sulphide and sulphite shall amount to 0.01–0.2, preferably 0.05-0.15, suitably 0.08–0.12.

12 Claims, No Drawings

PROCESS OF MAKING CELLULOSE PULP WITH A SULPHITE COOKING LIQUOR CONTAINING SULPHIDE AND A QUINONE OR HYDROQUINONE COMPOUND

This application is a continuation of application Ser. No. 876,867, filed as PCT SE85/00321 on Aug. 29, 1985, published as WO86/02393 on Apr. 24, 1986, now abandoned.

This invention relates to the making of cellulose pulp by processing wood or similar cellulose-containing starting material with alkalic sulphite cooking liquid containing small amounts of sulphide in the presence of anthraquinone or similar quinonoide substances. According to the invention, the cooking liquid consists of sodium sulphite, anthraquinone and small amounts of sulphide. The cooking liquid, in addition, may include sodium hydroxide and sodium carbonate. The process is characterized in that the mole ratio between sulphide and sulphite is in the range 0.01–0.2.

The present invention can be used in existing pulp mills (in sulphite pulp mills on sodium basis as well as in sulphate pulp mills). The amount of evil smelling compounds formed, however, is substantially smaller than at conventional sulphate digestion. The sulphate pulp mill, however, must be provided with (known) equipment for converting sulphide to sulphite. The invention renders it possible to manufacture pulp with good strength, similar to that of sulphate pulp, from different types of wood and in different yield ranges. The pulp, besides, is easy to bleach.

During the last decade, the sulphite process has become attractive again, due to the fact, that the recovery problems have been solved, and that it is now possible to manufacture pulps similar to sulphate.

Previously, two new digestion processes have been developed, viz. neutral sulphite-AQ and, respectively, alkalic sulphite-AQ, for the manufacture of high-yield pulps and pulps for bleaching. The division into neutral and alkalic sulphite is based mostly on the different digestion chemicals being charged, viz. $Na_2SO_3$ and $Na_2CO_3$ in neutral sulphite, and $Na_2SO_3$ and NaOH in alkalic sulphite. The pH-intervals (cold pH) for these digestion types, however, overlap. Neutral sulphite digestion normally is carried out at cold pH $<12.5$, and alkalic sulphite digestion in the pH-range 10–13.5. The greatest advantages of the sulphite-AQ process over the sulphate process are the substantially higher yield—$\sim$10% for high-yield pulps and $\sim$7% for fully bleached pulps—and the smaller amounts of evil smelling substances formed. The disadvantages are that, irrespective of the anthraquinone addition, the deliginification proceeds slower, the digesting time at maximum digestion temperature is longer, and a higher digestion chemical addition, compared with the sulphate process, is required for digestion to a certain kappa number. The slightly lower strength does not seem restrictory for the process.

The process according to the present invention shows all the advantages of a sulphite-AQ process. The amount of evil smelling substances assumedly is slightly higher, but still is on a much lower level compared with the amount of evil smelling substances formed at the sulphate process.

The sulphite-sulphide process heretofore has interested a few researchers. Peckham and van Druven investigated 1961 the sulphite process with Na-basis for the entire pH-range. The investigation also included two sulphite-sulphide processes. The results showed that the solving-out of lignin as well as the viscosity and strength of the pulp depended strongly on the composition of the cooking liquid (sulphite-sulphide-alkali). Similar results were obtained at a later date by Hinrichs in Sv. Papperstidning 73 (1973), No 5: 122 and 76 (1973), No 5: 182. He was the only researcher who had studied in greater detail the SS-process (for high-yield pulps, kappa number 50). According to Hinrichs, the optimum liquid composition for obtaining the highest possible polymerization degree was 28% $Na_2SO_3$ and 12% $Na_2S$ (all calculated in NaOH on wood) and with NaOH and the $Na_2CO_3$-charge 0%. Hinrichs made his eperiments at high liquid:wood ratios (6:1) and at very high total chemical charges ($\sim$10 mol Na/kg wood).

A. Teder and F. Johansson have published in STFI-Kontakt, No. 5, 1978, that AQ accelerates the solving-out of lignin during an SS-digestion. The pulp was also at this investigation treated with an SS-cooking liquid where the sulphide-sulphite ratio was on a substantially higher level compared with the process described according to the invention.

The present invention relates to a process for the manufacture of chemical pulp where together with anthraquinone small amounts of sodium sulphide are added to the sulphite cooking liquor. Owing to the sulphide addition, the solving-out of lignin increases, and the digesting time at maximum digestion temperature, and therewith also the steam consumption, can be reduced. Furthermore, also the demand on chemicals decreases. An addition of sodium sulphide corresponding to a mole ratio between sulphide and sulphite of the magnitude 0.01–0.2 is sufficient. The necessary sulphide amount can be obtained easily, for example by directing a small amount of green liquor past the apparatus where sodium sulphide is converted to sodium sulphite solution. The amount of evil smelling substances formed at the digestion with the aforesaid cooking liquor is substantially smaller than at conventional sulphate digestion.

The process according to the invention offers advantages over alkalic sulphite with or without anthraquinone in respect of delignification, and over the sulphate digestion in the entire kappa number range in respect of yield, but is especially advantageous at kappa numbers exceeding 40–50. The pulps manufactured with high kappa numbers, however, advantageously can be delignified to lower kappa numbers in an additional delignification step of the type digestion with pure alkali, oxygen gas in alkali, etc.

The invention hereinafter will be called MSS-AQ process, where MSS means mini-sulphite-sulphide digestion, i.e. sulphite-sulphide digestion with low sulphide charges.

In the following some examples of the invention are described.

EXAMPLE 1

300 g pine chips was charged into a 2-liter autoclave. The autoclave was evacuated for 30 minutes whereafter the cooking liquor was sucked in. The liquor:wood ratio was 4.5:1. Pressure impregnation with 0.5 MPa $N_2$-pressure was carried out for 30 minutes.

The composition of the cooking liquor for MSS-AQ digestion and reference digestion were as follows:

| Digestion type | Cooking liquor $Na_2SO_3$ as mole | $Na_2S$ Na/kg wood | NaOH | AQ % on wood |
|---|---|---|---|---|
| MSS-AQ | 7.36 | 0.64 | — | 0.15 |
| Sulphite-AQ | 8.00 | — | — | 0.15 |
| Conv. sulphate | — | 2.0 | 3.0 | — |

The digesting time until maximum digestion temperature, 170° C., was 100 minutes (from 70° C.).

After completed digestion, the pulps were washed and refined in an Asplund refiner for 30 seconds at 20° C.

The digestion results are shown in the following Table.

| Digestion type | Time at 170° C. min | Kappa number | Yield % |
|---|---|---|---|
| MSS-AQ | 160 | 46 | 55.2 |
| Sulphite-AQ | 160 | 92 | 66.8 |
| Conv. sulphate | 80 | 45 | 47.5 |

EXAMPLE 2

Digestion type as in Example 1.

The cooking liquor composition was as follows:

| Digestion type | Cooking liquor $Na_2SO_3$ mole Na/kg wood | $Na_2S$ | NaOH | AQ % on wood |
|---|---|---|---|---|
| MSS-AQ | 5.52 | 0.48 | — | 0.15 |
| Sulphite-AQ | 6.00 | — | — | 0.15 |
| Conv. sulphate | | 2.0 | 3.0 | — |

The digestion results were as follows:

| Digestion type | Time at 170° C. min | Kappa number | Yield % |
|---|---|---|---|
| MSS-AQ | 90 | 68 | 61.8 |
| MSS-AQ | 100 | 57 | 59.7 |
| Sulphite-AQ | 160 | 99 | 71.3 |
| Conv. sulphate | 65 | 66 | 51.6 |

EXAMPLE 3

Digestion type as in Example 1. No anthraquinone was added.

The cooking liquor composition was as follows:

| Digestion type | Cooking liquor $Na_2SO_3$ mole Na/kg wood | $Na_2S$ | NaOH | AQ % on wood |
|---|---|---|---|---|
| MSS-AQ | 7.0 | 1.0 | — | 0.15 |
| Sulphite-AQ | 8.0 | — | — | 0.15 |
| Conv. sulphate | — | 2.2 | 3.4 | — |

The digestion result was as follows:

| Digestion type | Time at 170° C. min | Kappa number | Viscosity $dm^3/kg$ | Yield % |
|---|---|---|---|---|
| MSS-AQ | 160 | 42 | 1590 | 53.5 |
| Sulphite-AQ | 160 | 84 | — | 68.5 |
| Conv. sulphate | 75 | 46 | 1256 | 51.0 |

The conventional SS-digestions with high sulphide proportions do not yield the above effect—rapid delignification at low alkalinity.

EXAMPLE 4

A comparison between MSS-AQ and so-called conventional SS-AQ.

Digestion type as in Example 1.

The cooking liquor composition was as follows:

| Digestion type | Cooking liquor $Na_2SO_3$ mole Na/kg wood | $Na_2S$ | AQ % on wood |
|---|---|---|---|
| MSS-AQ | 7.0 | 1.0 | 0.15 |
| SS-AQ | 4.0 | 4.0 | 0.15 |

The digestion result was as follows:

| Digestion time | Time at 170° C. min | Kappa number | Yield % |
|---|---|---|---|
| MSS-AQ | 160 | 42 | 53.5 |
| SS-AQ | 160 | 55.2 | 51.7 |

The invention is not restricted to the Examples described above, but can be varied within the scope of the invention idea.

We claim:

1. A process for the manufacture of pulp from wood comprising digesting an amount of wood with a sulphite cooking liquor containing sulphide and a quinone or hydroquinone compound, the mole ratio between sulphide and sulphite, calculated as $Na_2S$ and, respectively, $Na_2SO_3$, amounting to 0.05–0.2.

2. A process as defined in claim 1 wherein the digesting is terminated before arriving at a kappa number of 50.

3. A process as defined in claim 1 wherein digesting is continued in a subsequent step.

4. A process as defined in claim 1 wherein the quinone or hydroquinone compound is added in an amount of 0.01–0.20%, calculated on the amount of wood.

5. A process as defined in claim 2 wherein digesting is continued in a subsequent step.

6. A process as defined in claim 2 wherein the quinone or hydroquinone compound is added in an amount of 0.01–0.20%, calculated on the amount of wood.

7. A process as defined in claim 3 wherein the quinone or hydroquinone compound is added in an amount of 0.01–0.20%, calculated on the amount of wood.

8. A process as defined in claim 1 wherein the quinone or hydroquinone compound is anthraquinone, benzoquinone, naphthoquinone or 1,4-dihydro-9,10-dehydroxyanthracene.

9. A process as defined in claim 1 wherein the mole ratio between sulphide and sulphite is 0.05–0.15.

10. A process as defined in claim 1 wherein the mole ratio between sulphide and sulphite is 0.08–0.12.

11. A process as defined in claim 3 wherein the continued digesting is carried out with alkali sulphite cooking liquor or alkali and oxygen gas.

12. A process as defined in claim 5 wherein the continued digesting is carried out with alkali, sulphite cooking liquor or alkali and oxygen gas.

* * * * *